US011338342B2

(12) United States Patent
White et al.

(10) Patent No.: US 11,338,342 B2
(45) Date of Patent: May 24, 2022

(54) PAINTLESS DENT REMOVAL TOOL, SYSTEM AND METHOD

(71) Applicant: EHC INC., Oklahoma City, OK (US)

(72) Inventors: Chris White, Oklahoma City, OK (US); Reggie Ayers, Oklahoma City, OK (US); William J Bickel, Jr., Oklahoma City, OK (US)

( * ) Notice: Subject to any disclaimer, the term of this patent is extended or adjusted under 35 U.S.C. 154(b) by 0 days.

(21) Appl. No.: 17/003,369

(22) Filed: Aug. 26, 2020

(65) Prior Publication Data

US 2021/0060633 A1 Mar. 4, 2021

Related U.S. Application Data

(60) Provisional application No. 62/892,269, filed on Aug. 27, 2019.

(51) Int. Cl.
*B21D 1/06* (2006.01)

(52) U.S. Cl.
CPC ..... *B21D 1/06* (2013.01)

(58) Field of Classification Search
CPC . B21D 1/06; B21D 1/065; B21D 1/10; B21D 1/12; Y10S 72/705
See application file for complete search history.

(56) References Cited

U.S. PATENT DOCUMENTS

| | | | | |
|---|---|---|---|---|
| 2,938,412 | A * | 5/1960 | Walker | B21D 1/06 72/479 |
| 5,479,804 | A | 1/1996 | Cook | |
| 5,727,418 | A * | 3/1998 | Strozier | B21D 1/06 72/457 |
| 6,014,885 | A | 1/2000 | Griffaton | |
| 6,722,179 | B1 | 4/2004 | Ventura | |
| 6,957,561 | B1 | 10/2005 | Contreras | |
| 7,343,773 | B1 * | 3/2008 | Chan | B21D 1/06 72/479 |
| 9,669,442 | B1 | 6/2017 | Alvarez | |
| 9,757,782 | B2 | 9/2017 | Wilkinson | |
| 9,868,143 | B2 | 1/2018 | Zimmerman | |
| 9,889,483 | B1 | 2/2018 | Allen | |
| 10,245,629 | B1 | 4/2019 | Skelton et al. | |
| 10,252,308 | B2 | 4/2019 | Hummert | |

* cited by examiner

*Primary Examiner* — Teresa M Ekiert
(74) *Attorney, Agent, or Firm* — D. Ward Hobson

(57) ABSTRACT

A paintless dent repair glue tab tool, system and method. The paintless dent repair glue tab tool, includes a pull member detachably connected to a support member. The pull member having a top, a threaded neck, and a bottom. The support member having a thick rigid center having an opening extending at least partially therethrough and a thin semi-flexible outer edge extending around the thick rigid center. The opening having a threaded metal insert molded therein and configured to receive a portion of the threaded neck of the pull member. The diameter of the pull member and the diameter of the support member transfer lifting power to a center portion of the paintless dent repair glue tab tool so as to pull up the dent at a peak thereby more efficiently removing dents from the surface of a vehicle.

9 Claims, 9 Drawing Sheets

PAINTLESS DENT REMOVAL TOOL, SYSTEM AND METHOD

CROSS-REFERENCE TO RELATED APPLICATIONS

This application claims priority to U.S. Provisional Application No. 62/799,265 filed on Aug. 27, 2019, which is expressly incorporated herein by reference in its entirety.

FIELD OF INVENTION

The invention is in the technical field of paintless dent repair tools, systems and methods. The invention pertains generally to paintless dent repair glue tab tools, systems and methods used to "pull-out" a dent from a vehicle body, such as an automobile, aircraft, motorcycle or the like, for example.

BACKGROUND

Advancements in construction methods and materials have resulted in lighter and stronger vehicle bodies for automobiles, aircrafts, motorcycles and the like. However, such improved vehicle bodies are often increasingly prone to dents, dings and various other body deformations. Such damage may be caused by, for example, automobile accidents, hail or debris striking the outer surface of the vehicle body. Repairing such dents, dings and deformations can be difficult, laborious and time consuming, even when using traditional paintless dent repair tools and processes.

In general, paintless dent repair (sometimes known as "PDR") is the process of repairing dents to a vehicle body without repainting the vehicle. Thus, saving the owner of the vehicle time and money by avoiding the cost and expense of repainting the vehicle. Traditionally, in paintless dent repair, many repair shops utilize the flexibility and durability of the outer surface of the vehicle body to reach into vehicle body compartments to "push-out" a dent from the inside outward or "pull-out" a dent from the outside of the vehicle body. Once the dent is pushed or pulled out, there is also a need to partially "knock-down" or flatten out the dent to completely remove the dent.

Traditionally, repair shops have used a variety of tools to help assist with the paintless dent repair process, including tools designed to assist a user with the "push-out" and "pull-out" process and tools designed to assist a user with the "knock-down" process. One such traditional tool is known in the art as a "glue tab." Traditional glue tab tools generally have a top member, a neck member and a flexible bottom member. Traditional glue tab tools are configured so that the flexible bottom member is affixed to a dent with glue and the top member is pulled upward by a user (either by hand or by machine) to pull-out a dent in the vehicle body. The neck member of a traditional glue tab tool is generally of a relatively large and uniform or standard size diameter (for ease of manufacturing and strength of the tool) regardless of the size of the dent to be removed and regardless of the size of the flexible bottom member. Traditionally, this is to prevent the neck member from snapping and breaking when the top member is pulled upward during use.

When a traditional glue tab tool pulls a dent upward, the dent is pulled up around the circumference of the bottom of the neck member creating a curved arc or bump on the vehicle body where the dent is pulled-out. Unfortunately, however, this curved arc or bump is not precise and often covers an area that is larger or smaller than the actual dent.

Thus, the arc or bump must then be flattened back down using a knock down tool and then pulled back out using a traditional glue tab tool, usually multiple times, before the dent is ultimately removed. This process takes a significant amount of time to complete, is tedious, cumbersome and labor intensive. Thereby, increasing the cost and decreasing the effectiveness and usefulness of such traditional glue tab tools.

To that end, it would be advantageous to provide an improved paintless dent repair glue tab tool, system and method that is configured to more efficiently and precisely pull-out dents at a precise peak (instead of over an arc) to improve the accuracy and reliability of the dent removal process. To that end, the improved paintless dent repair glue tab tool is configured to have a neck member with a substantially smaller diameter in relation to the diameter of the flexible bottom member. The ratio of the diameter of the neck member to the diameter of the flexible bottom member creates an unexpected result in that it permits the improved paintless dent repair glue tab tool to pull-up the dent at a precise peak instead of over a rounded arc thereby significantly increasing the accuracy of the paintless dent repair glue tab tool. Accuracy is increased because the more narrow diameter of the neck member in relation to the diameter of the flexible bottom member permits the paintless dent repair glue tab tool to pull upward at a more precise center of the paintless dent removal glue tab tool without breaking or snapping the neck member.

This result is unexpected because it was generally understood in the art that reducing the diameter of the neck member would decrease the strength of traditional paintless dent removal glue tab tool and cause the neck member to break or snap. However, by decreasing the diameter of the neck member in relation to the diameter of the flexible bottom member, the strength of the paintless dent repair glue tab tool is maintained and the accuracy of the tool is greatly enhanced, permitting a dent to be pulled out at a precise peak (instead of over an arc). Thereby, providing a more accurate tool for a more precise repair of dents and reducing or eliminating the need for a knock down tool and removing or eliminating the need to use a traditional paintless dent repair glue tab tool multiple times in order to effectively remove a dent. Thus, significantly increasing the efficiency of the paintless dent repair process and reducing the overall cost.

SUMMARY OF THE INVENTION

The inventive concepts disclosed herein are generally directed to an improved paintless dent repair glue tab tool, system and method. The paintless dent repair glue tab tool, system and method are configured to more efficiently and precisely "pull-out" dents at a peak (instead of over an arc) directly from the center of the tool. The paintless dent repair glue tab tool generally includes a top member, a neck member and a flexible bottom member. The neck member is configured to have a smaller diameter than the diameter of the flexible bottom member and be within a specific preferred range as described herein. The ratio of the diameter of the neck member to the diameter of the flexible bottom member in the preferred range disclosed herein creates an unexpected result in that it permits the improved paintless dent repair glue tab tool to pull-up the dent from a vehicle body at a precise peak instead of over a rounded arc. Thereby substantially increasing the accuracy of the tool. This result is unexpected because it was commonly understood in the art that reducing the diameter of the neck member would negatively impact the glue tab tool by decreasing the overall strength of the glue tab tool and causing the neck member to snap or break.

Instead, by decreasing the diameter of the neck member in relation to the diameter of the flexible bottom member in the preferred ratio disclosed herein, the strength of the paintless dent repair glue tab tool is maintained and the accuracy of the tool is greatly enhanced. Thereby, providing a more accurate and repeatable repair of dents, reducing or eliminating the need for a knock down tool, and reducing or eliminating the need to use the improved paintless dent repair glue tab tool multiple times in order to effectively remove a dent. Thus, significantly increasing the accuracy and efficiency of the paintless dent repair process and reducing the overall cost.

In some embodiments, the neck member may also include bracing rods, members or filaments positioned within the neck member. The bracing rods, members or filaments are configured to provide additional structural strength to the neck member so that the diameter of the neck member may be further decreased in relation to the diameter of the flexible bottom member, thereby further increasing the ability of the improved paintless dent repair glue tab tool to pull out a dent at a precise peak and without causing the improved paintless dent repair glue tab tool to lose its structural integrity caused by having a narrow neck member.

The improved paintless dent repair glue tab tool generally includes a top member having a front, back, upper surface and lower surface. The improved paintless dent repair glue tab tool further includes a neck member having a first diameter. The neck member having a front, back, upper surface and lower surface. The upper surface of the neck member connected to the lower surface of the top member. The improved paintless dent repair glue tab tool further includes a flexible bottom member having a second diameter. The flexible bottom member having a front, back, upper surface and lower surface. The upper surface of the flexible bottom member connected to the lower surface of the neck member. The lower surface of the flexible bottom member configured to be affixed to a center portion of a dent in a vehicle body.

The first diameter of the neck member is in preferred range of about 1 mm to 7 mm and the second diameter of the flexible bottom member is in a preferred range of about 5 mm to 75 mm. Wherein, the first diameter of the neck member and the second diameter of the flexible bottom member have a ratio in a preferred range of about 2 to 1-12 to 1 flexible bottom member diameter to neck member diameter, so as to transfer lifting power to a center portion of the paintless dent repair glue tab tool for a precise pull that reduces over-pulling of the dent when the top member is pulled upward by a user. While a ratio in a range of about 2 to 1-12 to 1 flexible bottom member diameter to neck member diameter is preferred, it should be understood that the range of the ratio of the first diameter of the neck member to the second diameter of the flexible bottom member may be outside of the preferred range disclosed above, so long as the ratio is sufficient to transfer lifting power directly to a center portion of the paintless dent repair glue tab tool to permit the paintless dent repair glue tab tool to pull up a dent at a precise peak instead of over an arc consistent with the inventive concepts disclosed herein. For example, in some embodiments the ratio of the first diameter of the neck member and the and second diameter of the flexible bottom member may be outside this range if the neck member includes further bracing or reinforcing members or elements embedded within the neck member. For example, metal rods configured to provide additional strength and which may permit the diameter of the neck member to be further decreased in relation to the diameter of the flexible bottom member to provide greater accuracy.

In some embodiments, the lower surface of the flexible bottom member is configured to be affixed to a center portion of a dent in a vehicle body via glue. However, it should be understood that the flexible bottom member may be affixed to a center portion of the dent via any type of adhesive known in the art. Further, in some embodiments, the lower surface of the flexible bottom member is smooth to permit the adhesive to be adhered to the flexible bottom member without scratching the vehicle surface. However, it should be understood that in some embodiments the flexible bottom member may be rough so as to facilitate the adhesive to be more securely adhered to the vehicle surface. Further, in some embodiments, the paintless dent repair glue tab tool is constructed from polycarbonate, while in other embodiments the paintless dent repair glue tab tool is constructed from an impact resistant nylon, for example. The flexibility and rigidity of the paintless dent repair glue tab may vary depending on the type of material used, the size of the dent to be removed and the strength needed to effectively pull the dent out of the vehicle surface from the center of the paintless dent repair glue tab tool and without breaking the paintless dent repair glue tab tool.

BRIEF DESCRIPTION OF THE SEVERAL VIEWS OF THE DRAWINGS

Like reference numerals in the figures represent and refer to the same or similar element or function. Implementations of the disclosure may be better understood when consideration is given to the following detailed description thereof. Such description makes reference to the annexed pictorial illustrations, schematics, graphs, drawings, and appendices. In the drawings.

DETAILED DESCRIPTION OF EXEMPLARY EMBODIMENTS

Figure 2:
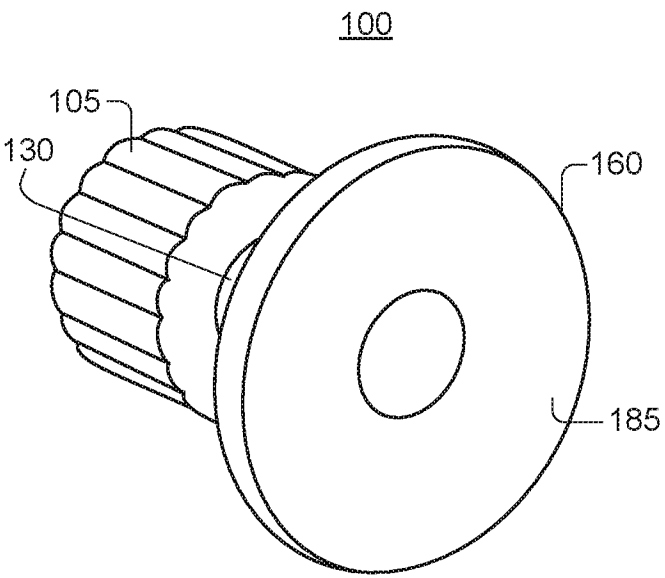
FIG. 2 is a bottom perspective view of an embodiment of a paintless dent repair glue tab tool (100) in accordance with the inventive concepts disclosed herein.

Before explaining at least one embodiment of the inventive concepts disclosed herein in detail, it is to be understood that the inventive concepts are not limited in their application to the details of construction and the arrangements of the components or steps or methodologies set forth in the following description or illustrated in the drawings. The inventive concepts disclosed herein are capable of other embodiments or of being practiced or carried out in various ways. Also, it is to be understood that the phraseology and terminology employed herein is for the purpose of description and should not be regarded as limiting the inventive concepts claimed herein in any way.

In the following detailed description of embodiments of the inventive concepts, numerous specific details are set forth in order to provide a more thorough understanding of the inventive concepts. However, it will be apparent to one of ordinary skill in the art that the inventive concepts within the disclosure may be practiced without these specific details. In other instances, well-known features have not been described in detail to avoid unnecessarily complicating the instant disclosure.

As used herein, the terms "comprises," "comprising," "includes," "including," "has," "having," or any other variation thereof, are intended to cover a non-exclusive inclusion. For example, a process, method, article, or apparatus that comprises a list of elements is not necessarily limited to only those elements but may include other elements not expressly listed.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concepts. This description should be read to include one or at least one and the singular also includes the plural unless it is obvious that it is meant otherwise.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Figure 1:
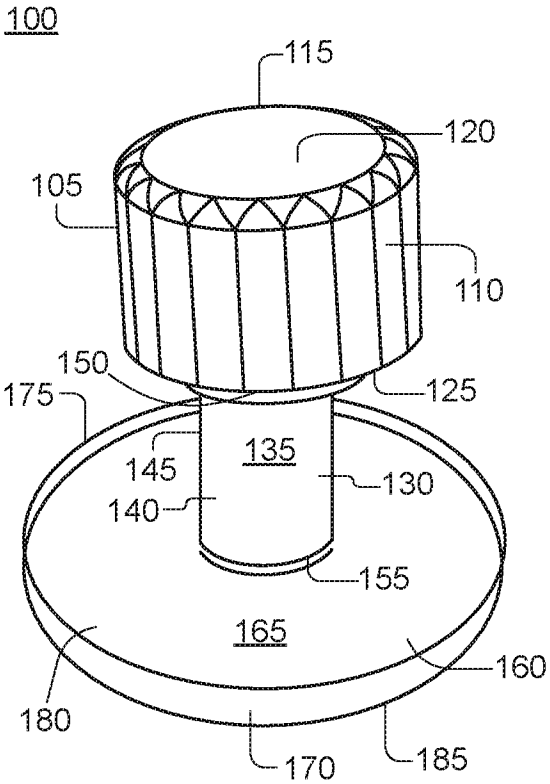
FIG. 1 is a perspective view of an embodiment of a paintless dent repair glue tab tool (100) in accordance with the inventive concepts disclosed herein.

Referring now to FIGS. 1-2, shown therein is a perspective view of an embodiment of a paintless dent repair glue tab tool (100). The paintless dent repair glue tab tool (100) includes a top member (105) having a front (110), back (115), upper surface (120) and lower surface (125). The paintless dent repair glue tab tool (100) further includes a neck member (130) having a first diameter (135). The neck member (130) having a front (140), back (145), upper surface (150) and lower surface (155). The upper surface (150) of the neck member (130) connected to the lower surface (125) of the top member (105). The paintless dent repair glue tab tool (100) further including a flexible bottom member (160) having a second diameter (165). The flexible bottom member (160) having a front (170), back (175), upper surface (180) and a lower surface (185). The upper surface (180) of the flexible bottom member (160) connected to the lower surface (155) of the neck member (130). The lower surface (185) of the flexible bottom member (160) configured to be affixed to a dent (195) in a vehicle body. Wherein, the first diameter (135) of the neck member (130) and the second diameter (165) of the flexible bottom member (160) have a ratio in a range of about 2 to 1-12 to 1 flexible bottom member (160) second diameter (165) to neck member (130) first diameter (135) and is configured to transfer lifting power to a center portion of the paintless dent repair glue tab tool (100) for a precise pull that reduces over-pulling of the dent (195) when the top member (105) is pulled upward by a user, either manually or by a machine. The first diameter (135) of the neck member (130) is in preferred range of about 1 mm to 7 mm and the second diameter (165) of the flexible bottom member (160) is in a preferred range of about 5 mm to 75 mm.

The paintless dent repair glue tab tool (100) is configured to more efficiently and precisely "pull-out" dents (such as dent 195) at a peak (instead of at an arc) directly from the center of the paintless dent repair glue tab tool (100). The paintless dent repair glue tab tool (100) includes a neck member (130) that has a smaller relative diameter (the first diameter 135) than the diameter (the second diameter 165) of the flexible bottom member (160). The ratio of the diameter between the neck member (130) and the flexible bottom member (160) creates an unexpected result in that it permits the improved paintless dent repair glue tab tool (100) to pull-up the dent (such as dent 195) from a vehicle body at a precise peak instead of at a rounded arc.

This result is unexpected because it was commonly understood in the art that reducing the diameter of the neck member would decrease the overall strength and thus decrease the effectiveness of the paintless dent repair glue tab tool. Instead, however, by decreasing the diameter of the neck member (130) in relation to the diameter of the flexible bottom member (160), the structural integrity of the paintless dent repair glue tab tool (100) is maintained and the accuracy of the paintless dent repair glue tab tool (100) is greatly enhanced, permitting a dent (such as dent 195) to be pulled out at a precise peak (instead of at an arc). A peak is preferable to an arc because it is a more narrow, precise and repeatable point, thus permitting a user to pull-up and repair dents in a more precise and efficient manner. Thereby, providing a more accurate tool for the repair of dents, reducing or eliminating the need for a knock down tool, and reducing or eliminating the need to use the improved paintless dent repair glue tab tool (100) multiple times in order to effectively remove the dent (such as dent 195). Thus, significantly increasing the efficiency of the paintless dent repair process and reducing the overall cost.

The paintless dent repair glue tab tool (100) may be constructed from any material of sufficient strength necessary to maintain the structural integrity of the paintless dent repair glue tab tool (100) when in use. For example, the paintless dent repair glue tab tool (100) may be constructed from non-metals such as, plastics, polycarbonate, impact resistant nylon, carbon fiber, polymers, resins, ceramics, composite materials or metals such as alloys, steel, titanium, combinations thereof and the like. Further, it should be understood that the top member (105), neck member (130) and flexible bottom member (160) may each be constructed from different materials. For example, in some embodiments, the top member (105) may be constructed from carbon fiber, while the neck member (130) may be constructed from plastic, while the flexible bottom member (160) may be constructed from a composite material.

The paintless dent repair glue tab tool (100) is shown as having a substantially circular shape. However, it should be understood that the paintless dent repair glue tab tool (100) may have any desired shape, including but not limited to, a generally rectangular, square or triangular shape for example. Further, the top member (105), neck member (130) and flexible bottom member (160) may each have a substantially different shape. For example, in some embodiments, the top member (105) may have a generally circular shape, while the neck member (130) may have a generally square shape, while the flexible bottom member (160) may have a generally rectangular shape.

The top member (105) includes a front (110), back (115), upper surface (120) and lower surface (125). The top member (105) is configured to be pulled upward by a user or a machine during use of the paintless dent repair glue tab tool (100). In some embodiments, the top member (105) may include ridges, ribs, bracing structures, pins or other components or structures sufficient to provide strength to the top member (105) so as to prevent the paintless dent repair glue tab tool (100) from breaking, deforming, or cracking when pulled upward by a user or machine. Further, the top member (105) may also be configured with a precise orientation or design so as to fit within or be used with a machine configured to pull the paintless dent repair glue tab tool (100) upward.

The neck member (130) has a front (140), back (145), upper surface (150) and lower surface (155). The upper surface (150) of the neck member (130) is connected to the lower surface (125) of the top member (105). The neck member (130) may be connected to the lower surface (125) of the top member (105) by welds, joints, seams, connectors or any other means in the art. Further, in some embodiments, the neck member (130) is constructed from the same unitary piece of material as the top member (105) such that the connection between the top member (105) and the neck member (130) is seamless.

The neck member (130) has a first diameter (135) in a range of about 1 mm to 7 mm. However, it should be understood to one of ordinary skill in the art that the first diameter (135) of the neck member (130) may be any desired diameter, within the preferred range of 1 mm to 7 mm or outside of this range, so long as the ratio between the first diameter (135) of the neck member (130) and second diameter (165) of the flexible bottom member (160) is in a preferred range of about 2 to 1-12 to 1 flexible bottom member (160) second diameter (165) to neck member (130) first diameter (135) or is in a range sufficient to permit the paintless dent repair glue tab tool (100) to pull up a dent at a precise peak instead of over an arc. This ratio permits the paintless dent repair glue tab tool (100) to transfer lifting power to a center portion of the paintless dent repair glue tab tool (100) for a precise pull that reduces over-pulling of the dent (195) when the top member (105) is pulled upward by a user or machine. The ratio between the first diameter (135) of the neck member (130) and the second diameter (165) of the flexible bottom member (160) transfers lifting power to the center of the paintless dent repair glue tab tool (100) for a more precise pull and removal of the dent (195). The ratio between the first diameter (135) of the neck member (130) and the second diameter (165) of the flexible bottom member (160) may be outside this preferred range, for example, if the neck member (130) further includes bracing or reinforcing members or rods, for example.

In some embodiments, the neck member (130) also includes bracing rods, members or filaments positioned within the neck member (130). The bracing rods, members or filaments are configured to provide additional structural strength to the neck member (130) so that the diameter of the neck member (130) may be further decreased in relation to the diameter of the flexible bottom member (160), thereby further increasing the ability of the paintless dent repair glue tab tool (100) to pull out a dent (such as dent 195) at a more precise peak and without causing the paintless dent repair glue tab tool (100) to lose its structural integrity caused by having an even more narrow neck member (130). The bracing rods, members or filaments may be constructed from metal, carbon fiber, plastics and the like for example.

The flexible bottom member (160) has a front (170), back (175), upper surface (180) and a lower surface (185). The upper surface (180) of the flexible bottom member (160) is connected to the lower surface (155) of the neck member (130). The lower surface (185) of the flexible bottom member (160) is configured to be affixed to a center portion (190) of a dent (195) in a vehicle body.

The flexible bottom member (160) may be constructed from any material of sufficient strength necessary to maintain the structural integrity of the paintless dent repair glue tab tool (100) when in use. For example, the flexible bottom member (160) may be constructed from non-metals such as, plastics, carbon fiber, polymers, polycarbonate, impact resistant nylon, resins, ceramics, composite materials or metals such as alloys, steel, titanium, combinations thereof and the like. Further, it should be understood that the top member (105), neck member (130) and flexible bottom member (160) may each be constructed from different materials. For example, in some embodiments, the flexible bottom member (16) may be constructed from carbon fiber, while the neck member (130) may be constructed from plastic, while the top member (105) may be constructed from metal.

It should be understood, however, that the flexible bottom member (160) must be sufficiently flexible to flex or bend when pulled upward so as to pull-up the dent without breaking. The flexible bottom member (160) should be constructed from a material capable of flexing or bending (without breaking), such as polycarbonate or impact resistant nylon for example, so that when the paintless dent repair glue tab tool (100) is pulled upward by a user (a person or machine) the dent may be pulled upward at peak around the circumference of the neck member without breaking the paintless dent removal tool.

The flexible bottom member (160) is shown as having a substantially circular shape. However, it should be understood that the flexible bottom member (160) may have any desired shape, including but not limited to, a generally rectangular, square or triangular shape for example. Further, the top member (105), neck member (130) and flexible bottom member (160) may each have a substantially different shape. For example, in some embodiments, the top member (105) may have a generally circular shape, while the neck member (130) may have a generally square shape, while the flexible bottom member (160) may have a generally rectangular shape. In some embodiments, the flexible bottom member (160) may include ridges, ribs, bracing structures, pins or other components or structures sufficient to provide strength and flexibility to the flexible bottom member (160) so as to prevent the paintless dent repair glue tab tool (100) from breaking, deforming or cracking when pulled upward by a user or machine.

The flexible bottom member (160) includes a front (170), back (175), upper surface (180) and a lower surface (185). The flexible bottom member (160) is configured to be affixed to a dent (195) by an adhesive, such as glue (220) for example. It should be understood however that the flexible bottom member (160) may be affixed to a dent by any means sufficiently strong to permit the paintless dent repair glue tab tool (100) to be affixed to the dent and be pulled upward so that the dent is pulled out of the vehicle body as described herein. Further, the adhesive should be capable of being easily applied and easily removed without causing damage, discoloration, scratches or deformations to the vehicle body. In some embodiments, the lower surface (185) of the flexible bottom member (160) is substantially smooth. While in some embodiments, the lower surface (185) of the flexible bottom member (160) may have ridges, bumps or creases, for example, so as to facilitate adhesion to the dent in the vehicle body.

The first diameter (135) of the neck member (130) and the second diameter (165) of the flexible bottom member (160) have a ratio in a range of about 2 to 1-12 to 1 flexible bottom member (160) second diameter (165) to neck member (130) first diameter (135) and is configured to transfer lifting power to a center portion of the paintless dent repair glue tab tool for a precise pull that reduces over-pulling of the dent (195) when the top member (105) is pulled upward by a user. The paintless dent repair glue tab tool (100) is configured to more efficiently and precisely "pull-out" dents (such as dent 195) at a peak (instead of at an arc) directly from the center of the paintless dent repair glue tab tool (100). The paintless dent repair glue tab tool (100) includes a neck member (130) that has a smaller relative diameter (the first diameter 135) than the diameter (the second diameter 165) of the flexible bottom member (160). The ratio of the diameter between the neck member (130) and the diameter of the flexible bottom member (160) creates an unexpected result in that it permits the improved paintless dent repair glue tab tool (100) to pull-up the dent (such as dent 195) from a vehicle body at a precise peak instead of at a rounded arc. This result is unexpected because it was commonly understood in the art that reducing the diameter of the neck member would decrease the overall strength and thus decrease the effectiveness of the paintless dent repair glue tab tool.

Instead, however, by decreasing the diameter of the neck member (130) in relation to the diameter of the flexible bottom member (160), the structural integrity of the paintless dent repair glue tab tool (100) is maintained and the accuracy of the paintless dent repair glue tab tool (100) is greatly enhanced, permitting a dent (such as dent 195) to be pulled out at a precise peak (instead of at an arc). A peak is preferable to an arc because it is a more narrow, precise and repeatable point, thus permitting a user to pull-up and repair dents in a more precise and efficient manner. Thereby, providing a more accurate tool for the repair of dents, reducing or eliminating the need for a knock down tool, and reducing or eliminating the need to use the improved paintless dent repair glue tab tool (100) multiple times in order to effectively remove the dent (such as dent 195). Thus, significantly increasing the efficiency of the paintless dent repair process and reducing the overall cost.

The flexible bottom member (160) has a second diameter (165) in a range of about 5 mm to 75 mm. However, it should be understood to one of ordinary skill in the art that the second diameter (165) of the flexible bottom member (160) may be any desired diameter so long as the ratio between the first diameter (135) of the neck member (130) and the second diameter (165) of the flexible bottom member (160) is in a range of about 2 to 1-12 to 1 flexible bottom member (160) second diameter (165) to neck member (130) first diameter (135) or a different range so long as the range is sufficient to permit the paintless dent repair glue tab tool (100) to pull out dents at a precise peak instead of over an arc. This ratio permits the paintless dent repair glue tab tool (100) to transfer lifting power to a center portion of the paintless dent repair glue tab tool (100) for a precise pull that reduces over-pulling of the dent (195) when the top member (105) is pulled upward by a user or machine.

Figure 4:
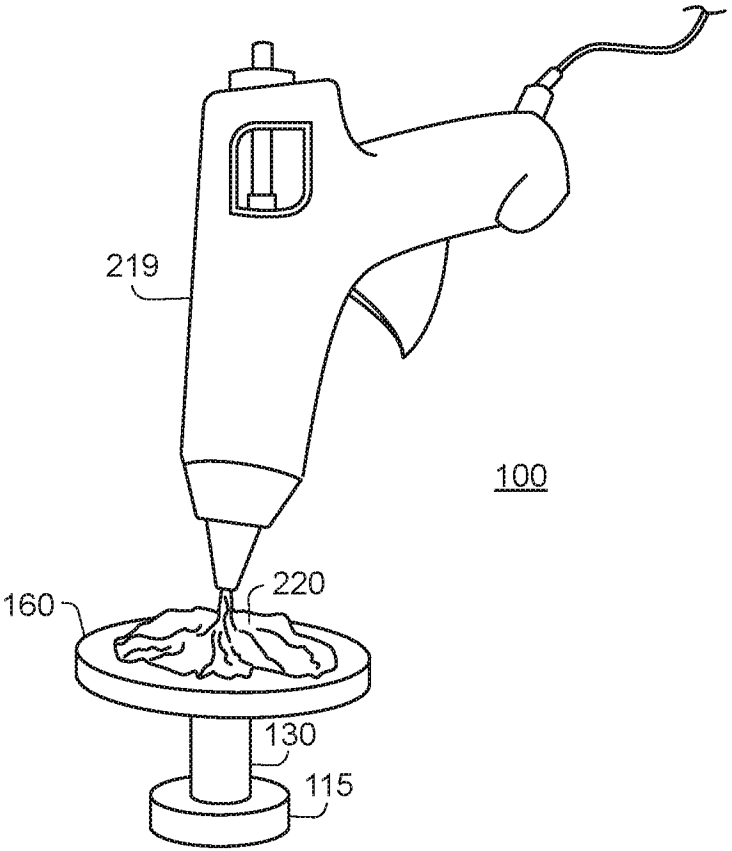
FIG. 4 is a perspective view of a glue gun (219) shown applying glue (220) to an embodiment of a paintless dent repair glue tab tool (100) in accordance with the inventive concepts disclosed herein.
Figure 3:
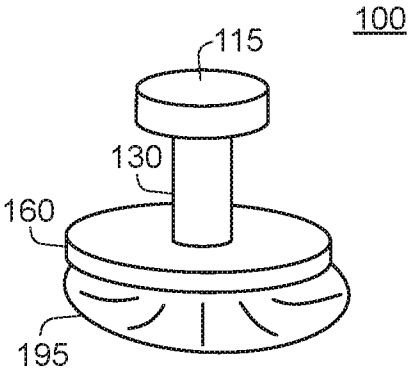
FIG. 3 is a perspective view of an embodiment of a paintless dent repair glue tab tool (100) positioned above a dent (195) in accordance with the inventive concepts disclosed herein.
Figure 5:
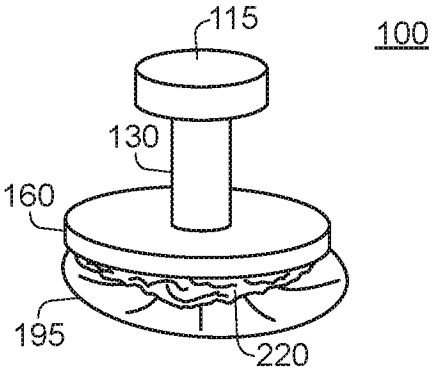
FIG. 5 is a perspective view of an embodiment of a paintless dent repair glue tab tool (100) positioned above a dent (195) in accordance with the inventive concepts disclosed herein.

Referring now to FIGS. 3-5 shown therein is a perspective view of a paintless dent repair glue tab tool (100) in accordance with the inventive concepts disclosed herein. FIG. 3 is a perspective view of an embodiment of a paintless dent repair glue tab tool (100) positioned above a dent (195) in accordance with the inventive concepts disclosed herein. FIG. 4 is a perspective view of a glue gun (219) shown applying glue (220) to an embodiment of a paintless dent repair glue tab tool (100) in accordance with the inventive concepts disclosed herein. FIG. 5 is a perspective view of an embodiment of a paintless dent repair glue tab tool (100) positioned above a dent (195) in accordance with the inventive concepts disclosed herein.

As shown therein, the paintless dent repair glue tab tool (100) includes a top member (105) having a front (110), back (115), upper surface (120) and lower surface (125). The paintless dent repair glue tab tool (100) further includes a neck member (130) having a first diameter (135). The neck member (130) having a front (140), back (145), upper surface (150) and lower surface (155). The upper surface (150) of the neck member (130) connected to the lower surface (125) of the top member (105). The paintless dent repair glue tab tool (100) further including a flexible bottom member (160) having a second diameter (165). The flexible bottom member (160) having a front (170), back (175), upper surface (180) and a lower surface (185). The upper surface (180) of the flexible bottom member (160) connected to the lower surface (155) of the neck member (130). The lower surface (185) of the flexible bottom member (160) configured to be affixed to a dent (195) in a vehicle body. Wherein, the first diameter (135) of the neck member (130) and the second diameter (165) of the flexible bottom member (160) have a ratio in a range of about 2 to 1-12 to 1 flexible bottom member (160) second diameter (165) to neck member (130) first diameter (135) and is configured to transfer lifting power to a center portion of the paintless dent repair glue tab tool (100) for a precise pull that reduces over-pulling of the dent (195) when the top member (105) is pulled upward by a user, either manually or by a machine.

As shown therein, in use, the flexible bottom member (160) is configured to be affixed to a dent (195) by an adhesive, such as glue (220) from a glue gun (219) for example. It should be understood however that the flexible bottom member (160) may be affixed to a dent by any means sufficiently strong to permit the paintless dent repair glue tab tool (100) to be affixed to the dent and be pulled upward so that the dent is pulled out of the vehicle body as described herein. Further, the adhesive should be capable of being easily applied and easily removed without causing damage, discoloration, scratches or deformations to the vehicle body. In some embodiments, the lower surface (185) of the flexible bottom member (160) is substantially smooth. While in some embodiments, the lower surface (185) of the flexible bottom member (160) may have bumps, ridges or creases, for example, so as to facilitate adhesion to the dent in the vehicle body.

The paintless dent repair glue tab tool (100) is configured to more efficiently and precisely "pull-out" dents (such as dent 195) at a peak (instead of at an arc) directly from the center of the paintless dent repair glue tab tool (100). The paintless dent repair glue tab tool (100) includes a neck member (130) that has a smaller relative diameter (the first diameter 135) than the diameter (the second diameter 165) of the flexible bottom member (160). The ratio of the diameter between the neck member (130) and the flexible bottom member (160) creates an unexpected result in that it permits the improved paintless dent repair glue tab tool (100) to pull-up the dent (such as dent 195) from a vehicle body at a precise peak instead of at a rounded arc.

This result is unexpected because it was commonly understood in the art that reducing the diameter of the neck member would decrease the overall strength and thus decrease the effectiveness of the paintless dent repair glue tab tool. Instead, however, by decreasing the diameter of the neck member (130) in relation to the diameter of the flexible bottom member (160), the structural integrity of the paintless dent repair glue tab tool (100) is maintained and the accuracy of the paintless dent repair glue tab tool (100) is greatly enhanced, permitting a dent (such as dent 195) to be pulled out at a precise peak (instead of over an arc).

A peak is preferable to an arc because it is a more narrow, precise and repeatable point, thus permitting a user to pull-up and repair dents in a more precise and efficient manner. Thereby, providing a more accurate tool for the repair of dents, reducing or eliminating the need for a knock down tool, and reducing or eliminating the need to use the improved paintless dent repair glue tab tool (100) multiple times in order to effectively remove the dent (such as dent 195). Thus, significantly increasing the efficiency of the paintless dent repair process and reducing the overall cost.

Figure 6:
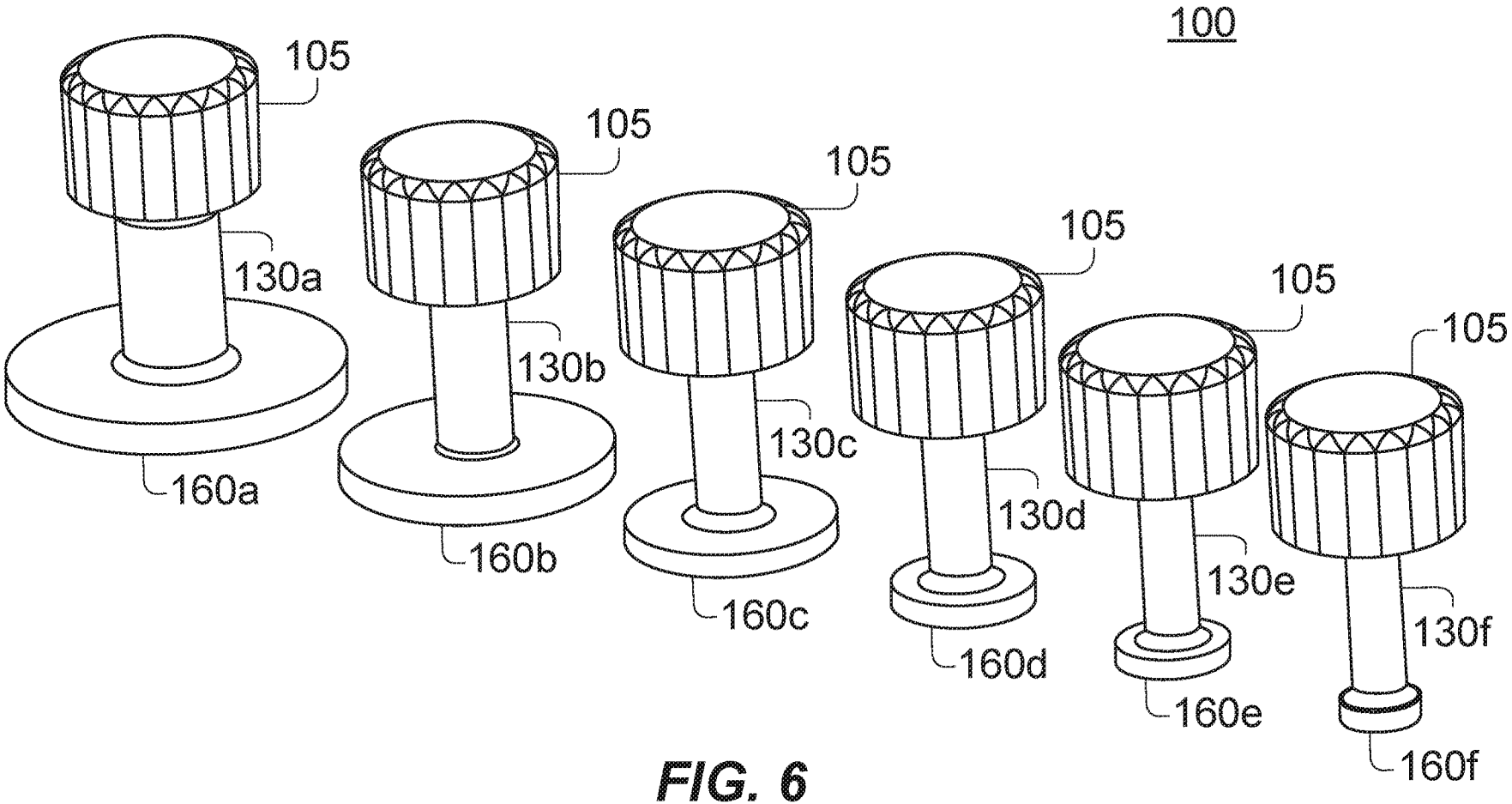
FIG. 6 is a perspective view of six alternate embodiments of a paintless dent repair glue tab tool (100) each having alternate configurations of a neck member (**130*a*-130*f*) and alternate configurations of a flexible bottom member (160*a*-160*f***) in accordance with the inventive concepts disclosed herein.

Referring now to FIG. 6 shown therein is a perspective view of six alternate embodiments of a paintless dent repair glue tab tool (100) each having alternate configurations of a neck member (130*a*-130*f*) and alternate configurations of a flexible bottom member (160*a*-160*f*) in accordance with the inventive concepts disclosed herein. The paintless dent repair glue tab tool (100) includes a top member (105) having a front (110), back (115), upper surface (120) and lower surface (125). The paintless dent repair glue tab tool (100) further includes a neck member (130*a*-1300 having a first diameter (135). The neck member (130*a*-130*f*) having a front (140), back (145), upper surface (150) and lower surface (155). The upper surface (150) of the neck member (130*a*-130*f*) connected to the lower surface (125) of the top member (105). The paintless dent repair glue tab tool (100) further including a flexible bottom member (160*a*-160*f*) having a second diameter (165). The flexible bottom member (160) having a front (170), back (175), upper surface (180) and a lower surface (185). The upper surface (180) of the flexible bottom member (160) connected to the lower surface (155) of the neck member (130*a*-130*f*). The lower surface (185) of the flexible bottom member (160) configured to be affixed to a dent (195) in a vehicle body. Wherein, the first diameter (135) of the neck member (130*a*-130*f*) and the second diameter (165) of the flexible bottom member (160*a*-160*f*) have a ratio in a range of about 2 to 1-12 to 1 flexible bottom member (160) second diameter (165) to neck member (130) first diameter (135) and is configured to transfer lifting power to a center portion of the paintless dent repair glue tab tool (100) for a precise pull that reduces over-pulling of the dent (195) when the top member (105) is pulled upward by a user, either manually or by a machine.

As shown in FIG. 6, in some embodiments, the configuration of the neck member (130*a*-130*f*) and the configuration of the flexible bottom member (160*a*-160*f*) may have a variety of different sizes and configurations designed for different sized or shaped dents. For example, a larger dent may require a larger sized flexible bottom member, such as 160*a*, whereas a smaller sized dent may need a smaller sized flexible bottom member, such as (160*f*). The size and configuration of the neck member (130*a*-130*f*) are configured to provide structural rigidity and strength to the paintless dent repair glue tab tool (100) when in use and so as to prevent the paintless dent repair glue tab tool (100) from breaking when it is pulled upward by a user or machine to pull out the dent in the vehicle body.

The paintless dent repair glue tab tool (100) is configured to more efficiently and precisely "pull-out" dents (such as dent 195) at a peak (instead of at an arc) directly from the center of the paintless dent repair glue tab tool (100). The paintless dent repair glue tab tool (100) includes a neck member (130*a*-130*f*) that has a smaller relative diameter than the diameter of the flexible bottom member (160*a*-160*f*). The ratio of the diameter between the neck member (130*a*-130*f*) and the flexible bottom member (160*a*-160*f*) creates an unexpected result in that it permits the improved paintless dent repair glue tab tool (100) to pull-up the dent (such as dent 195) from a vehicle body at a precise peak instead of at a rounded arc. This result is unexpected because it was commonly understood in the art that reducing the diameter of the neck member would decrease the overall strength and thus decrease the effectiveness of the paintless dent repair glue tab tool.

Instead, however, by decreasing the diameter of the neck member (130*a*-130*f*) in relation to the diameter of the flexible bottom member (160*a*-160*f*), the structural integrity of the paintless dent repair glue tab tool (100) is maintained and the accuracy of the paintless dent repair glue tab tool (100) is greatly enhanced, permitting a dent (such as dent 195) to be pulled out at a precise peak (instead of at an arc). A peak is preferable to an arc because it is a more narrow, precise and repeatable point, thus permitting a user to pull-up and repair dents in a more precise and efficient manner. Thereby, providing a more accurate tool for the repair of dents, reducing or eliminating the need for a knock down tool, and reducing or eliminating the need to use the improved paintless dent repair glue tab tool (100) multiple times in order to effectively remove the dent (such as dent 195). Thus, significantly increasing the efficiency of the paintless dent repair process and reducing the overall cost.

Further, in some embodiments, the neck member (130*a*-130*f*) also includes bracing rods, members or filaments positioned within the neck member (130*a*-130*f*). The bracing rods, members or filaments are configured to provide additional structural strength to the neck member (130*a*-130*f*) so that the diameter of the neck member (130*a*-130*f*) may be further decreased in relation to the diameter of the flexible bottom member (160*a*-160*f*), thereby further increasing the ability of the paintless dent repair glue tab tool (100) to pull out a dent (such as dent 195) at a more precise peak and without causing the paintless dent repair glue tab tool (100) to lose its structural integrity caused by having an even more narrow neck member (130*a*-130*f*). The bracing rods, members or filaments may be constructed from metal, carbon fiber, plastics and the like for example.

Figure 7:
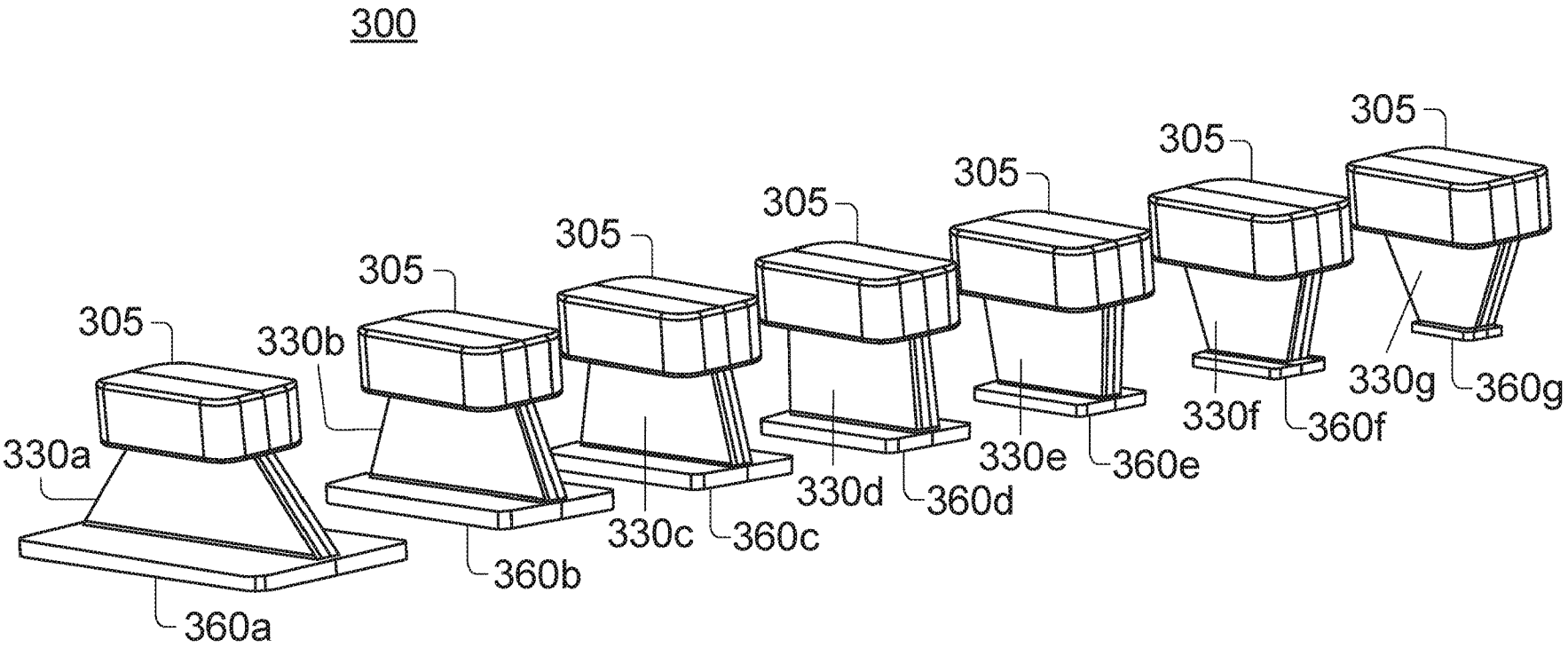
FIG. 7 is a perspective view of seven alternate embodiments of a paintless dent repair glue tab tool (300) each having alternative configurations of a neck member (**330*a*-330*g*) and alternative configurations of a flexible bottom member (360*a*-360*g***) in accordance with the inventive concepts disclosed herein.

Referring now to FIG. 7 shown therein is a perspective view of seven alternate embodiments of a paintless dent repair glue tab tool (300) each having alternative configurations of a neck member (330*a*-330*g*) and alternative configurations of a flexible bottom member (360*a*-360*g*) in accordance with the inventive concepts disclosed herein. The paintless dent repair glue tab tool (300) is configured similar to that of the paintless dent repair glue tab tool (100) described in detail above.

The paintless dent repair glue tab tool (300) includes a top member (305) having a front (310), back (315), upper surface (320) and lower surface (325). The paintless dent repair glue tab tool (300) further includes a neck member (330*a*-330*g*) having a first diameter (335). The neck member (330*a*-330*g*) having a front (340), back (345), upper surface (350) and lower surface (355). The upper surface (350) of the neck member (330*a*-330*g*) connected to the lower surface (325) of the top member (305). The paintless dent repair glue tab tool (300) further including a flexible bottom member (360*a*-360*g*) having a second diameter (365). The flexible bottom member (360) having a front (370), back (375), upper surface (380) and a lower surface (385). The upper surface (380) of the flexible bottom member (360) connected to the lower surface (355) of the neck member (330*a*-330*g*). The lower surface (385) of the flexible bottom member (360) configured to be affixed to a dent (195) in a vehicle body. Wherein, the first diameter (335) of the neck member (330*a*-330*g*) and the second diameter (365) of the flexible bottom member (360*a*-360*g*) have a ratio in a range of about 2 to 1-12 to 1 flexible bottom member (360*a*-360*g*) second diameter (365) to neck member (330*a*-33*g*) first diameter (335) and is configured to transfer lifting power to a center portion of the paintless dent repair glue tab tool (300) for a precise pull that reduces over-pulling of the dent (195) when the top member (305) is pulled upward by a user, either manually or by a machine.

As shown in FIG. 7, in some embodiments, the configuration of the neck member (330*a*-330*g*) and the configuration of the flexible bottom member (360*a*-360*g*) may have a variety of different sizes and configurations designed for different sized or shaped dents. For example, a larger dent may require a larger sized flexible bottom member, such as flexible bottom member (360*a*), whereas a smaller sized dent may need a smaller sized flexible bottom member, such as flexible bottom member 360*g*. The size, shape and configuration of the neck member (330*a*-330*g*) are configured to provide structural rigidity and strength to the paintless dent repair glue tab tool (300) when in use and so as to prevent the paintless dent repair glue tab tool (300) from breaking when it is pulled upward by a user or machine to pull out the dent in the vehicle body.

The paintless dent repair glue tab tool (300) is configured to more efficiently and precisely "pull-out" dents (such as dent 195) at a peak (instead of at an arc) directly from the center of the paintless dent repair glue tab tool (300). The paintless dent repair glue tab tool (300) includes a neck member (330*a*-330*g*) that has a smaller relative diameter than the diameter of the flexible bottom member (360*a*-360*g*). The ratio of the diameter between the neck member (330*a*-330*g*) and the flexible bottom member (360*a*-360*g*) creates an unexpected result in that it permits the improved paintless dent repair glue tab tool (300) to pull-up the dent (such as dent 195) from a vehicle body at a precise peak instead of at a rounded arc.

This result is unexpected because it was commonly understood in the art that reducing the diameter of the neck member would decrease the overall strength and thus decrease the effectiveness of the paintless dent repair glue tab tool. Instead, however, by decreasing the diameter of the neck member (330*a*-330*g*) in relation to the diameter of the flexible bottom member (360*a*-360*g*), the structural integrity of the paintless dent repair glue tab tool (300) is maintained and the accuracy of the paintless dent repair glue tab tool (300) is greatly enhanced, permitting a dent (such as dent 195) to be pulled out at a precise peak (instead of at an arc). A peak is preferable to an arc because it is a more narrow, precise and repeatable point, thus permitting a user to pull-up and repair dents in a more precise and efficient manner. Thereby, providing a more accurate tool for the repair of dents, reducing or eliminating the need for a knock down tool, and reducing or eliminating the need to use the improved paintless dent repair glue tab tool (300) multiple times in order to effectively remove the dent (such as dent 195). Thus, significantly increasing the efficiency of the paintless dent repair process and reducing the overall cost.

Further, in some embodiments, the neck member (330*a*-330*g*) also includes bracing rods, members or filaments positioned within the neck member (330*a*-330*g*). The bracing rods, members or filaments are configured to provide additional structural strength to the neck member (330*a*-330*g*) so that the diameter of the neck member (330*a*-330*g*) may be further decreased in relation to the diameter of the flexible bottom member (360*a*-360*g*), thereby further increasing the ability of the paintless dent repair glue tab tool (300) to pull out a dent (such as dent 195) at a more precise peak and without causing the paintless dent repair glue tab tool (300) to lose its structural integrity caused by having an even more narrow neck member (330*a*-330*g*). The bracing rods, members or filaments may be constructed from metal, carbon fiber, plastics and the like for example.

Figure 8:
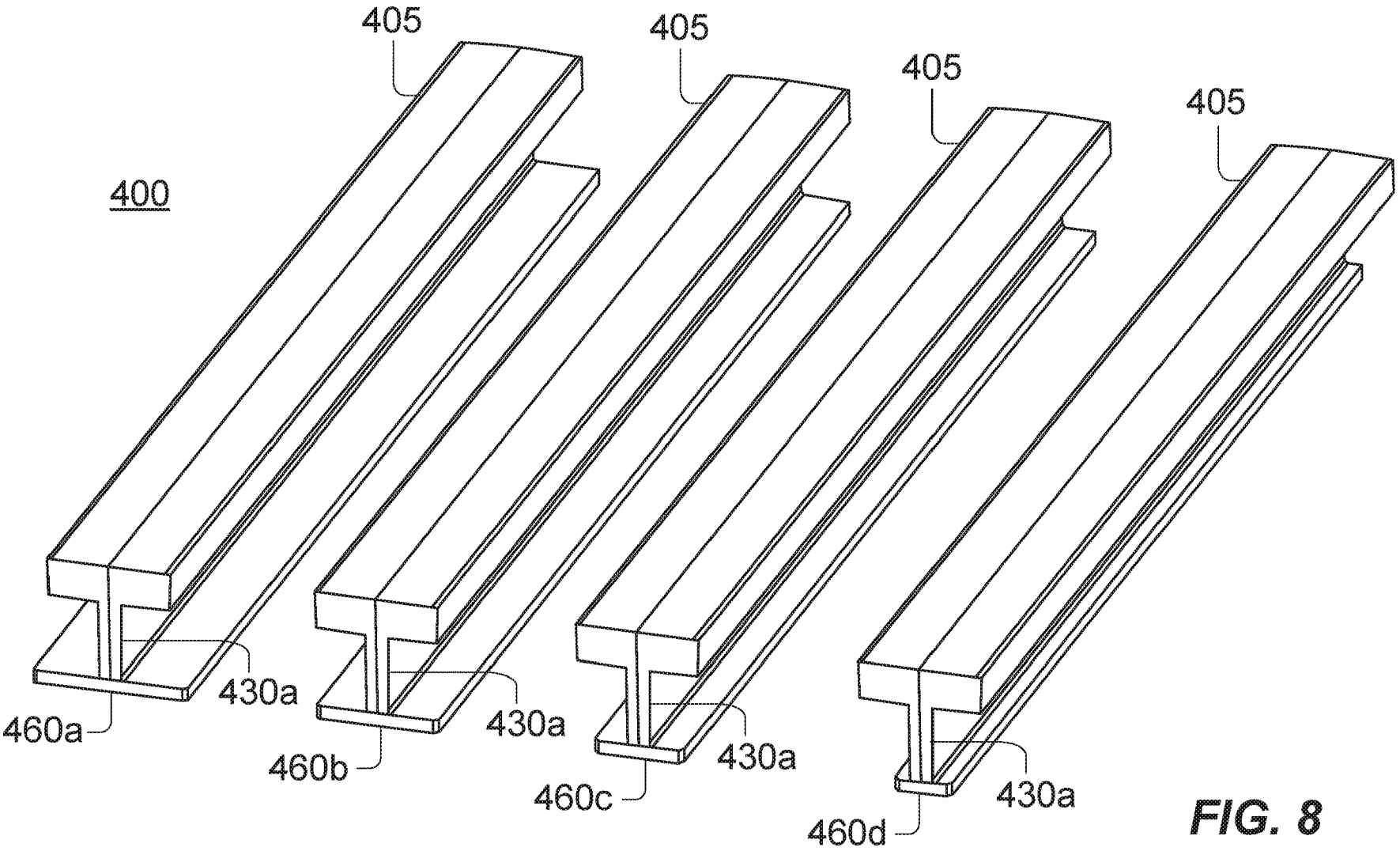
FIG. 8 is a perspective view of four alternate embodiments of a paintless dent repair glue tab tool (400) each having alternative configurations of a neck member (430*a*-430*d*) and alternative configurations of a flexible bottom member (460*a*-460*d*) in accordance with the inventive concepts disclosed herein.
Figure 9:
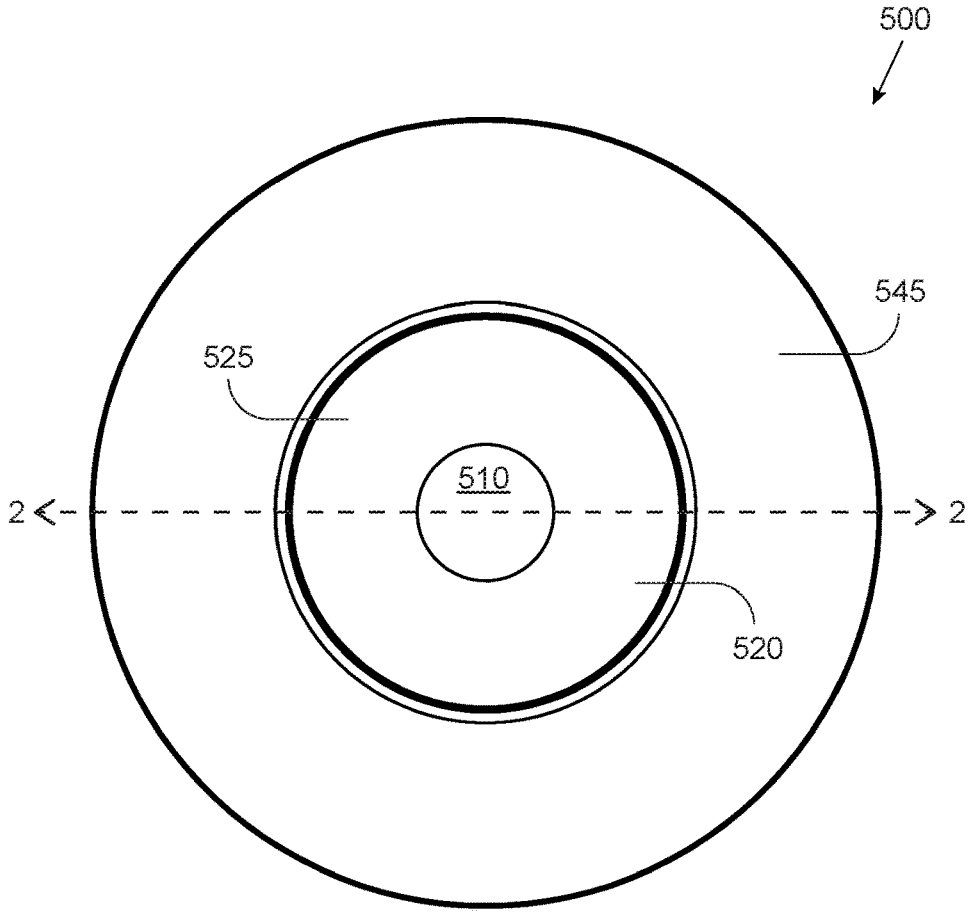
FIG. 9 is a side perspective view of an embodiment of a paintless dent repair glue tab tool (500) in accordance with the inventive concepts disclosed herein.
Figure 10:
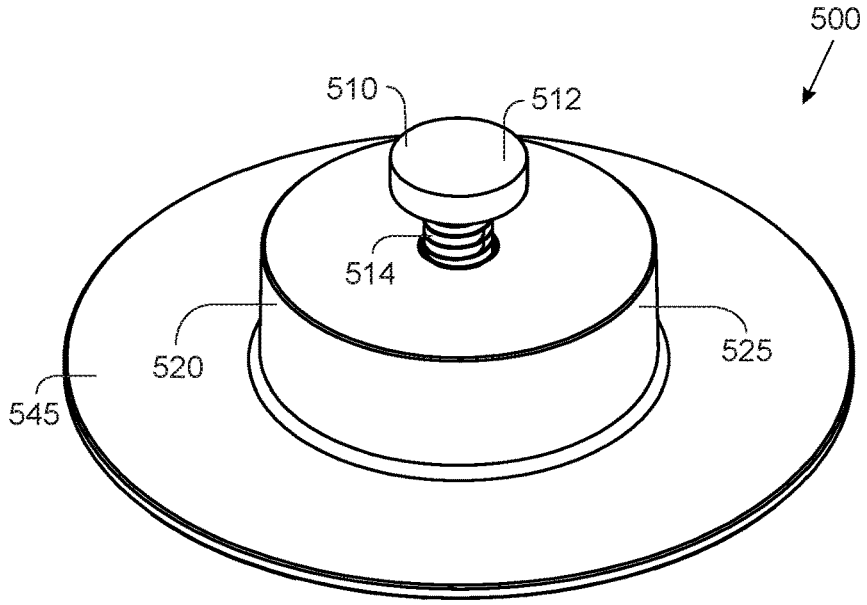
FIG. 10 is a top perspective view of an embodiment of a paintless dent repair glue tab tool (500) in accordance with the inventive concepts disclosed herein.
Figure 11:
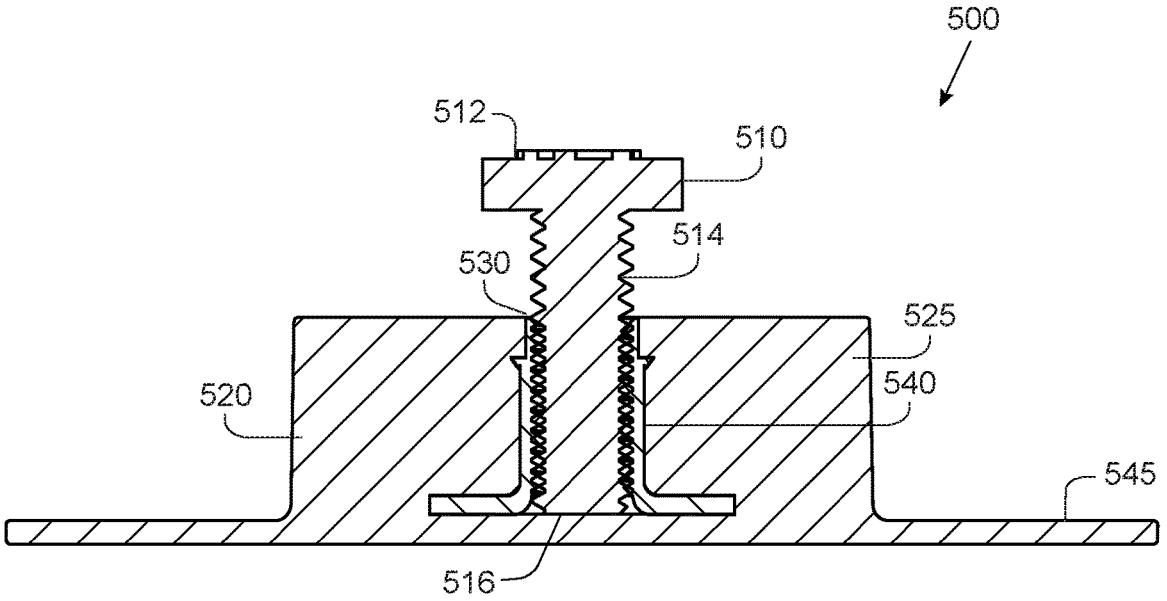
FIG. 11 is a side section perspective view of an embodiment of a paintless dent repair glue tab tool (500) in accordance with the inventive concepts disclosed herein.
Figure 12:
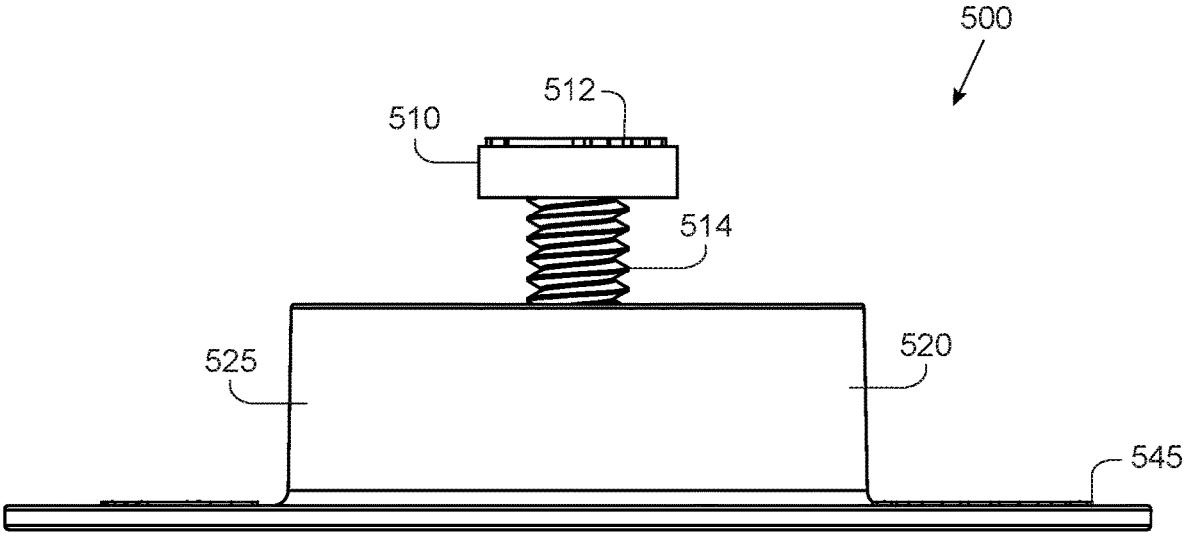
FIG. 12 is a side perspective view of an embodiment of a paintless dent repair glue tab tool (500) in accordance with the inventive concepts disclosed herein.

Referring now to FIG. 8 shown therein is a perspective view of four alternate embodiments of a paintless dent repair glue tab tool (400) each having alternative configurations of a neck member (430*a*-430*d*) and alternative configurations of a flexible bottom member (460*a*-460*d*) in accordance with the inventive concepts disclosed herein. The paintless dent repair glue tab tool (400) is configured similar to that of the paintless dent repair glue tab tool (100) and the paintless dent repair glue tab tool (300) described in detail above.

The paintless dent repair glue tab tool (400) includes a top member (405) having a front (410), back (415), upper surface (420) and lower surface (425). The paintless dent repair glue tab tool (400) further includes a neck member (430*a*-430*d*) having a first diameter (435). The neck member (430*a*-430*d*) having a front (440), back (445), upper surface (450) and lower surface (455). The upper surface (450) of the neck member (430*a*-430*d*) connected to the lower surface (425) of the top member (405). The paintless dent repair glue tab tool (400) further including a flexible bottom member (460*a*-460*d*) having a second diameter (465). The flexible bottom member (460) having a front (470), back (475), upper surface (480) and a lower surface (485). The upper surface (480) of the flexible bottom member (460) connected to the lower surface (455) of the neck member (430*a*-430*d*). The lower surface (485) of the flexible bottom member (460) configured to be affixed to a dent (195) in a vehicle body. Wherein, the first diameter (435) of the neck member (430*a*-430*d*) and the second diameter (465) of the flexible bottom member (460*a*-460*d*) have a ratio in a range of about 2 to 1-12 to 1 flexible bottom member (460*a*-460*d*) second diameter (465) to neck member (430*a*-430*d*) first diameter (435) and is configured to transfer lifting power to a center portion of the paintless dent repair glue tab tool (400) for a precise pull that reduces over-pulling of the dent (195) when the top member (405) is pulled upward by a user, either manually or by a machine.

As shown in FIG. 8, in some embodiments, the configuration of the neck member (430*a*-430*d*) and the configuration of the flexible bottom member (460*a*-460*d*) may have a variety of different sizes and configurations designed for different sized or shaped dents. For example, a larger dent may require a larger sized flexible bottom member, such as flexible bottom member 460*a*, whereas a smaller sized dent may need a smaller sized flexible bottom member, such as flexible bottom member 460*d*. The size, shape and configuration of the neck member (430*a*-430*d*) are configured to provide structural rigidity and strength to the paintless dent repair glue tab tool (400) when in use and so as to prevent the paintless dent repair glue tab tool (400) from breaking when it is pulled upward by a user or machine to pull out the dent in the vehicle body.

The paintless dent repair glue tab tool (400) is configured to more efficiently and precisely "pull-out" dents (such as dent 195) at a peak (instead of at an arc) directly from the center of the paintless dent repair glue tab tool (400). The paintless dent repair glue tab tool (400) includes a neck member (430*a*-430*d*) that has a smaller relative diameter than the diameter of the flexible bottom member (460*a*-460*d*). The ratio of the diameter between the neck member (430*a*-430*d*) and the diameter of the flexible bottom member (460*a*-460*d*) creates an unexpected result in that it permits the improved paintless dent repair glue tab tool (400) to pull-up the dent (such as dent 195) from a vehicle body at a precise peak instead of at a rounded arc. This result is unexpected because it was commonly understood in the art that reducing the diameter of the neck member would decrease the overall strength and thus decrease the effectiveness of the paintless dent repair glue tab tool. Instead, however, by decreasing the diameter of the neck member (430*a*-430*d*) in relation to the diameter of the flexible bottom member (460*a*-460*d*), the structural integrity of the paintless dent repair glue tab tool (400) is maintained and the accuracy of the paintless dent repair glue tab tool (400) is greatly enhanced, permitting a dent (such as dent 195) to be pulled out at a precise peak (instead of at an arc).

A peak is preferable to an arc because it is a more narrow, precise and repeatable point, thus permitting a user to pull-up and repair dents in a more precise and efficient manner. Thereby, providing a more accurate and repeatable tool for the repair of dents, reducing or eliminating the need for a knock down tool, and reducing or eliminating the need to use the improved paintless dent repair glue tab tool (400) multiple times in order to effectively remove the dent (such as dent 195). Thus, significantly increasing the efficiency of the paintless dent repair process and reducing the overall cost.

Further, in some embodiments, the neck member (430*a*-430*d*) also includes bracing rods, members or filaments positioned within the neck member (430*a*-430*d*). The bracing rods, members or filaments are configured to provide additional structural strength to the neck member (430*a*-430*d*) so that the diameter of the neck member (430*a*-430*d*) may be further decreased in relation to the diameter of the flexible bottom member (460*a*-460*d*), thereby further increasing the ability of the paintless dent repair glue tab tool (400) to pull out a dent (such as dent 195) at a more precise peak and without causing the paintless dent repair glue tab tool (400) to lose its structural integrity caused by having an even more narrow neck member (430*a*-430*d*). The bracing rods, members or filaments may be constructed from metal, carbon fiber, plastics and the like for example.

Referring now to FIGS. 9-13, shown therein is an embodiment of a paintless dent repair glue tab tool (500) in accordance with the inventive concepts disclosed herein. The paintless dent repair glue tab tool (500) includes a pull member (510) and a support member (520). The pull member (510) having a top (512), a threaded neck (514) and a bottom (516). The support member (520) having a thick rigid center (525) having an opening (530) extending at least partially therethrough. The opening (530) having a threaded metal insert (540) molded therein and configured to receive a portion of the threaded neck (514) of the pull member (510). The support member (520) further having a thin semi-flexible outer edge (545) extending around the rigid center (525) for additional support and to help adhere the bottom of the support member (520) to the surface of a vehicle.

In use, the pull member (510) may be selectively connected and disconnected to the support member (520) by threading the threaded neck (514) into or out of the threaded metal insert (540). The bottom of the support member (520) is adhered to the surface of a vehicle, using glue or the like. Once the support member (520) is adhered to the surface of a vehicle and the pull member (510) is threaded into the opening (530), a user may then manually or by means of a machine, pull the top of the pull member (510), causing the thick rigid center (525) to pull the dent upward and out of the surface of the vehicle. The diameter of the thick rigid center (525) being substantially equal to the diameter of the dent that is pulled upward and out of the vehicle surface.

The diameter of the opening (530), metal insert (540), threaded neck (514), rigid center (525), and outer edge (545) are configured to transfer lifting power to a center portion of the paintless dent repair glue tab tool (500) for a precise pull that reduces over-pulling of a dent when the top (512) of the pull member (510) is pulled upward by a user, either manually or by a machine. The diameter of the threaded neck (514) is in a preferred range of about 1 to 7 mm and the diameter of the rigid center (525) and outer edge (545) may have a diameter in a preferred range of about 5 mm to 75 mm. The thickness or length of the rigid center (525), may vary, but is configured to be substantially the same length as the pull member (510), so as to provide support and help prevent the pull member (510) from breaking or snapping during use. It being understood that the diameter of the opening (530), metal insert (540), threaded neck (514), rigid center (525), and outer edge (545) may vary, depending upon the size of the dent to be removed.

Each pull member (510) may be constructed from a variety of different materials, including, but not limited to metals, plastics, molded polycarbonate, nylon or other materials. Each pull member (510) may also be formed in a variety of different sizes and shapes, depending upon the size and shape of the dent to be removed. Further, each pull member (510) may be attached to a machine, such as a Slide Hammer, K-Bar, K-Beam or other pulling device known in the art. Likewise, each support member (520) may be constructed from a variety of different materials, including, but not limited to, metals, plastics, molded polycarbonate, nylon or other materials. Each support member (520) may, likewise, be formed in a variety of different sizes and shapes, depending upon the size and shape of the dent to be removed.

As previously discussed with regards to the other embodiments disclosed herein, the paintless dent repair glue tab tool (500) is configured to more efficiently and precisely "pull-out" dents (such as dent 195) at a peak (instead of at an arc) directly from the center of the paintless dent repair glue tab tool (500). The paintless dent repair glue tab tool (500) includes a threaded neck (514) that has a smaller relative diameter than the diameter of the rigid center (525). The ratio of the diameter between the threaded neck (514) and the rigid center (525) creates an unexpected result in that it permits the improved paintless dent repair glue tab tool (500) to pull-up the dent from a vehicle body at a precise peak instead of at a rounded arc.

This result is unexpected because it was commonly understood in the art that reducing the diameter of the threaded neck (514) would decrease the overall strength and thus decrease the effectiveness of the paintless dent repair glue tab tool (500). Instead, however, by decreasing the diameter of the threaded neck (514) in relation to the diameter of the support member (520), the structural integrity of the paintless dent repair glue tab tool (500) is maintained and the accuracy of the paintless dent repair glue tab tool (500) is greatly enhanced, permitting a dent to be pulled out at a precise peak (instead of at an arc).

A peak is preferable to an arc because it is a more narrow, precise and repeatable point, thus permitting a user to pull-up and repair dents in a more precise and efficient manner. Thereby, providing a more accurate tool for the repair of dents, reducing or eliminating the need for a knock down tool, and reducing or eliminating the need to use the improved paintless dent repair glue tab tool (500) multiple times in order to effectively remove the dent. Thus, significantly increasing the efficiency of the paintless dent repair process and reducing the overall cost.

Figure 13A:
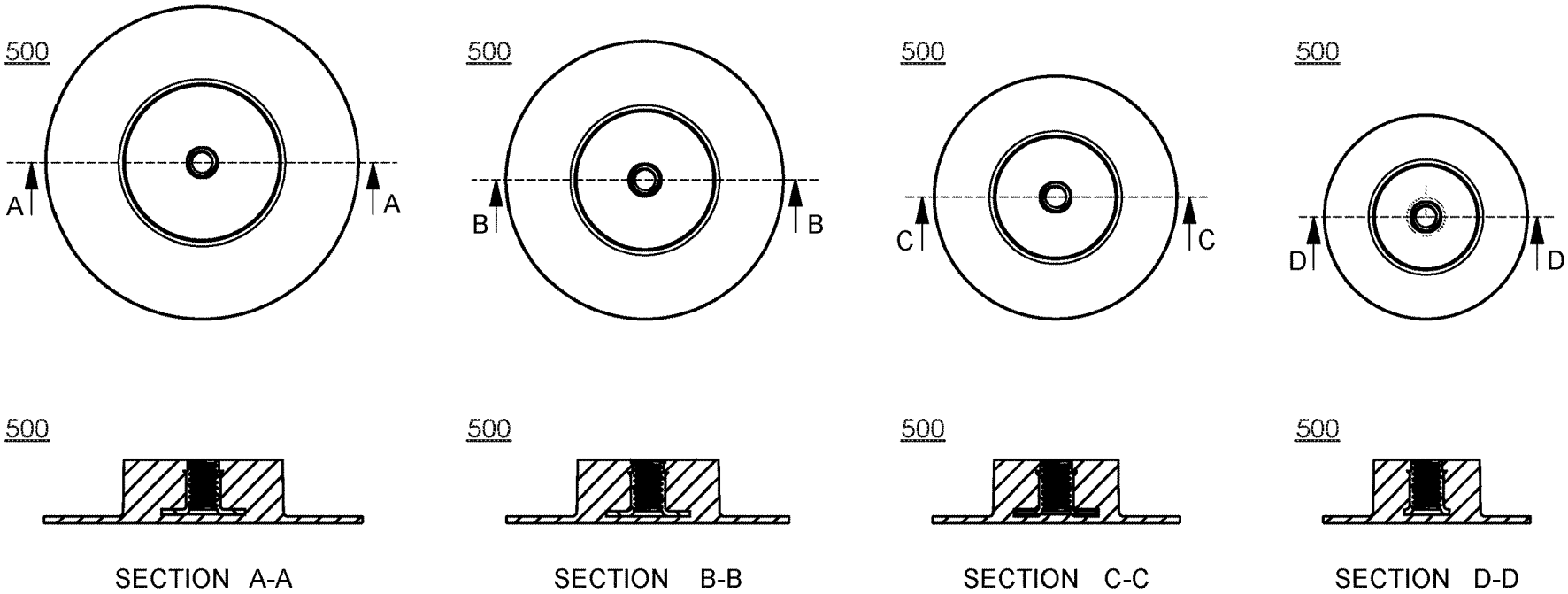
FIG. 13A and FIG. 13B show a perspective view of ten alternate embodiment of a paintless dent repair glue tab tool (500) shown in a variety of different sizes.
Figure 13B:
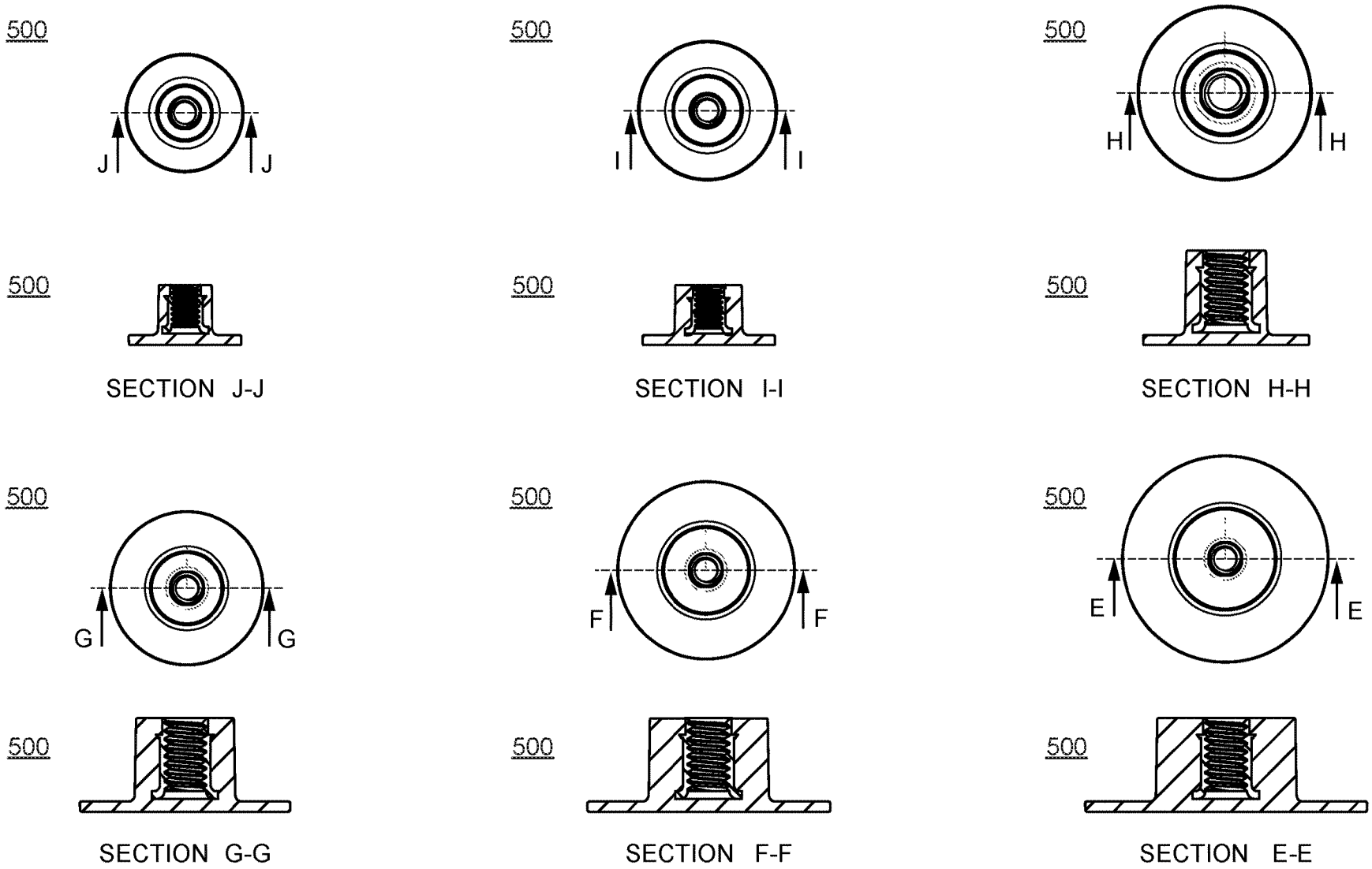

As shown in FIGS. 13A and 13B, the paintless dent repair glue tab tool (500) may be configured in a variety of different sizes based upon the size of the dent to be removed. The features of the paintless dent repair glue tab tool (500) are described above and are shown in more detail in FIGS. 11-12. Referring now to FIGS. 13A and 13B, the paintless dent repair glue tab tool (500) may be configured for use in a variety of different sizes. For example, in some embodiments, the diameter of the threaded neck (514) may have a diameter in a range from 1 to 7 mm and the diameter of the rigid center (525) and outer edge (545) may have a diameter in a range of 5 mm to 75 mm. The thickness or length of the rigid center (525), may vary, but is configured to be substantially the same length as the pull member (510), so as to provide support and help prevent the pull member (510) from breaking or snapping during use. It being understood that the diameter of the opening (530), metal insert (540), threaded neck (514), rigid center (525), and outer edge (545) may vary, depending upon the size of the dent to be removed.

In some embodiments the pull member (510) may be inserted directly into the opening (530), wherein in some embodiments the opening (530) includes the metal insert (540), which may be molded therein so as to provide additional strength to the paintless dent removal tool (500). The metal insert (540) may be thick or in some embodiments may be thin, for example. The thickness of the metal insert (540) may be modified depending upon the size of the dent to be removed. The metal insert (540) may be constructed from steel, aluminum, or various other metals and alloys. Further, in some embodiments, an insert that is not metal may be used in place of the metal insert (540). For example, an insert comprised of carbon fiber or other materials sufficient to provide increased strength to the paintless dent removal tool (500). Further, in some embodiments the metal insert (540) or other non-metal insert, may be fully integrated into the rigid center (525) or in other embodiments may be a stand-alone piece that may be selectively inserted into the rigid center (525) for example.

It is to be appreciated that embodiments of the inventive concepts disclosed herein may be shipped fully or partially assembled, or fully or partially disassembled in the form of a kit, as will be readily appreciated by persons of ordinary skill in the art having the benefit of the instant disclosure.

From the above description, it is clear that the inventive concepts disclosed herein are adapted to carry out the objects and to attain the advantages mentioned herein as well as those inherent in the inventive concepts disclosed herein. While exemplary embodiments of the inventive concepts disclosed herein have been described for purposes of this disclosure, it will be understood that numerous changes may be made which will readily suggest themselves to those skilled in the art and which are accomplished within the broad scope of the inventive concepts disclosed herein and defined by the appended claims.

What is claimed is:

1. A paintless dent repair glue tab tool comprising:

a top member, the top member having a front, back, upper surface and lower surface;

a neck member having a first diameter, the neck member having a front, back, upper surface and lower surface, the upper surface of the neck member connected to the lower surface of the top member;

a metal member embedded within the neck member to provide the neck member with additional structural strength;

a flexible bottom member having a second diameter, the flexible bottom member having a front, back, upper surface and a lower surface, the upper surface of the flexible bottom member connected to the lower surface of the neck member, the lower surface of the flexible bottom member configured to be affixed to a dent in a vehicle body; and wherein, the first diameter of the neck member and the second diameter of the flexible bottom member are configured to transfer lifting power to a center portion of the paintless dent repair glue tab tool so as to pull up the dent at a peak.

2. The paintless dent repair glue tab tool of claim 1, wherein the first diameter of the neck member and the second diameter of the flexible bottom member have a ratio in a range of about 2 to 1 and 12 to 1 flexible bottom member second diameter to neck member first diameter.

3. The paintless dent repair glue tab tool of claim 1, wherein the first diameter of the neck member and the second diameter of the flexible bottom member have a ratio in a range of about 2 to 1 and 12 to 1 flexible bottom member second diameter to neck member first diameter.

4. The paintless dent repair glue tab tool of claim 1, wherein the second diameter of the flexible bottom member is in a range of about 5 mm to 75 mm.

5. The paintless dent repair glue tab tool of claim 1, wherein the lower surface of the flexible bottom member is configured to be affixed to a dent in a vehicle body via glue.

6. The paintless dent repair glue tab tool of claim 1, wherein the lower surface of the flexible bottom member is smooth.

7. The paintless dent repair glue tab tool of claim 1, wherein the lower surface of the flexible bottom member has ridges.

8. The paintless dent repair glue tab tool of claim 1, wherein the paintless dent repair glue tab tool is constructed from polycarbonate.

9. The paintless dent repair tool of claim 1, wherein the paintless dent repair glue tab tool is constructed from an impact resistant nylon.

* * * * *